US010276962B2

(12) United States Patent
Nishida et al.

(10) Patent No.: US 10,276,962 B2
(45) Date of Patent: Apr. 30, 2019

(54) TERMINAL WITH A CASE, A COIL SPRING COMPRESSED IN THE CASE, A CONDUCTIVE MEMBER SANDWICHED BETWEEN THE CASE AND AN END OF THE COIL SPRING AND A WIRE CONNECTED TO THE CONDUCTIVE MEMBER

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shiro Nishida, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/770,571

(22) PCT Filed: Oct. 7, 2016

(86) PCT No.: PCT/JP2016/079908
§ 371 (c)(1),
(2) Date: Apr. 24, 2018

(87) PCT Pub. No.: WO2017/073291
PCT Pub. Date: May 4, 2017

(65) Prior Publication Data

US 2018/0316113 A1 Nov. 1, 2018

(30) Foreign Application Priority Data

Oct. 28, 2015 (JP) ..... 2015-211717

(51) Int. Cl.
*H01R 13/24* (2006.01)
*H01R 4/48* (2006.01)
(Continued)

(52) U.S. Cl.
CPC ..... *H01R 13/2421* (2013.01); *H01R 4/4872* (2013.01); *H01R 13/03* (2013.01); *H01R 13/502* (2013.01)

(58) Field of Classification Search
CPC . H01R 13/2428; H01R 24/2421; H01R 11/18
(Continued)

(56) References Cited

U.S. PATENT DOCUMENTS 5,993,245 A * 11/1999 Osada ..... H01R 4/4836 439/441
2005/0070173 A1 3/2005 Zheng et al.
2016/0069556 A1 3/2016 Li

FOREIGN PATENT DOCUMENTS

| | | |
|---|---|---|
| JP | 9-164027 | 6/1997 |
| JP | 2002-274290 | 9/2002 |
| WO | 2015/027663 | 3/2015 |

OTHER PUBLICATIONS

International Search Report dated Jan. 10, 2017.

* cited by examiner

*Primary Examiner* — Phuong K Dinh
(74) *Attorney, Agent, or Firm* — Gerald E. Hespos; Michael J. Porco; Matthew T. Hespos

(57) ABSTRACT

A terminal (10) includes a case (20), and a coil spring (30) is accommodated in a compressed state inside the case (20). A first conductive member (40) is sandwiched between one end of the coil spring (30) and an inner wall of the case (20) and has a contact portion (43) movable in a direction to compress the coil spring (30) farther. A flexible wire (60) is
(Continued)

connected to the first conductive member (40) and is disposed outside the coil spring (30).

6 Claims, 11 Drawing Sheets

(51) Int. Cl.
*H01R 13/03* (2006.01)
*H01R 13/502* (2006.01)
(58) Field of Classification Search
USPC ..... 439/819, 822, 700, 515
See application file for complete search history.

TERMINAL WITH A CASE, A COIL SPRING COMPRESSED IN THE CASE, A CONDUCTIVE MEMBER SANDWICHED BETWEEN THE CASE AND AN END OF THE COIL SPRING AND A WIRE CONNECTED TO THE CONDUCTIVE MEMBER

BACKGROUND

Field of the Invention

This specification relates to a terminal.

Description of the Related Art

Japanese Unexamined Patent Publication No. 2002-274290 discloses a power supply device to be electrically connected by butting contacts against each other. This power supply device is composed of a female junction provided on a body side and a male junction provided on a door side. The female junction is provided such that one end of a case in the form of a hollow tube is exposed to outside from the body. Left and right end plates are provided inside the case, and a coil spring sandwiched and compressed between these end plates. A leaf spring member is fixed to the end plate located on the body side, and one end of the leaf spring member is connected electrically by being butted against a contact provided on the female junction. On the other hand, a cord wire is connected to the other end of the leaf spring member and pulled out to the outside of the case through the inside of the coil spring.

The cord wire is arranged inside the coil spring in the above-described power supply device. Thus, cord wires having a wire diameter larger than an inner diameter of the coil spring cannot be used, and it may not be possible to use the above-described power supply device for large current.

SUMMARY

A terminal disclosed by this specification includes a case, and a coil spring is accommodated in a compressed state inside the case. A first conductive member is sandwiched between a first end of the coil spring and an inner wall of the case. The first conductive member has a contact portion movable in a direction to compress the coil spring farther. A flexible wire is connected to the first conductive member and is disposed outside the coil spring. According to this configuration, a wire having a larger wire diameter than an inner diameter of the coil spring can be used. Thus, a thick wire can be used as compared to the case where the wire is arranged inside the coil spring. Further, the coil spring is accommodated in the compressed state inside the case so that a large contact pressure can be obtained even if a movement amount of the contact portion is small.

The terminal may further include a second conductive member sandwiched between a second end of the coil spring and the inner wall of the case. A first end of the wire may be connected to the first conductive member, a second end of the wire may be connected to the second conductive member and an area of the wire from the first end to the second end may be disposed outside the case. According to this configuration, the area of the wire from the first end to the second end is disposed outside the case. Thus, a wire having a wire diameter larger than the inner space of the case can be used, and a thicker wire can be used than in an instance where the wire is arranged inside the case.

The case includes a first support for supporting a first end of the first conductive member and a second support for supporting the second end of the first conductive member. The contact portion is arranged on an axis of the coil spring and between the first and second supports. According to this configuration, the contact portion is arranged on the axis of the coil spring. Thus, a spring force of the coil spring can be transferred directly to the contact portion. Further, a force transferred from the coil spring to the contact portion is supported in a dispersed manner at two positions, i.e. at the first support and the second support. Thus, a coil spring having an even larger spring force can also be used.

According to the terminal disclosed by this specification, it is possible to use a wire having a larger wire diameter than an inner diameter of a coil spring.

DETAILED DESCRIPTION

Figure 1:
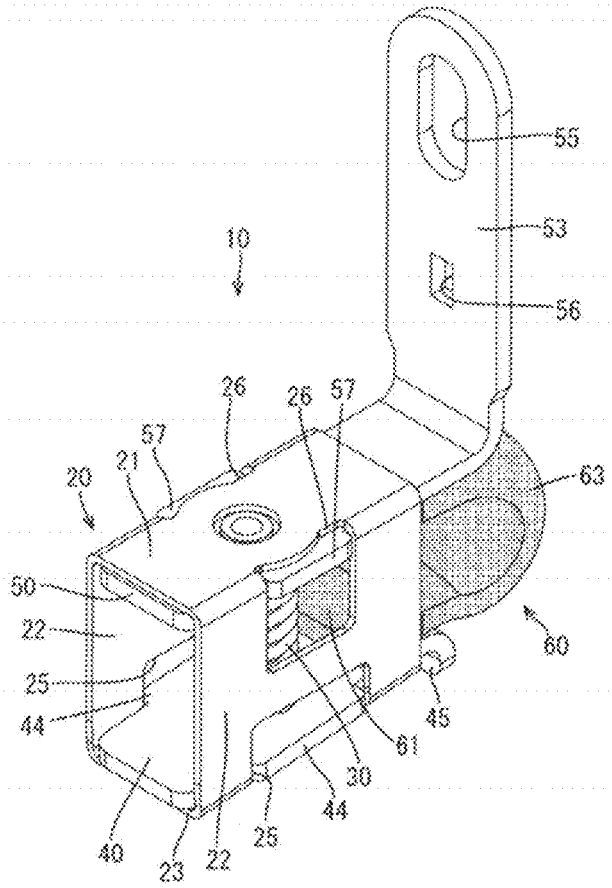
FIG. 1 is a perspective view of a terminal in an embodiment.

An embodiment is described with reference to FIGS. 1 to 11. A terminal 10 of this embodiment includes, as shown in FIG. 1, a case 20, a coil spring 30 accommodated in a compressed state inside the case 20, a first conductive member 40 and a second conductive member 50 disposed on both ends of the coil spring 30 and a wire 60 conductively connecting the both conductive members 40, 50. The wire 60 in this embodiment is a braided wire made of metal wires of copper alloy or the like.

Figure 2:
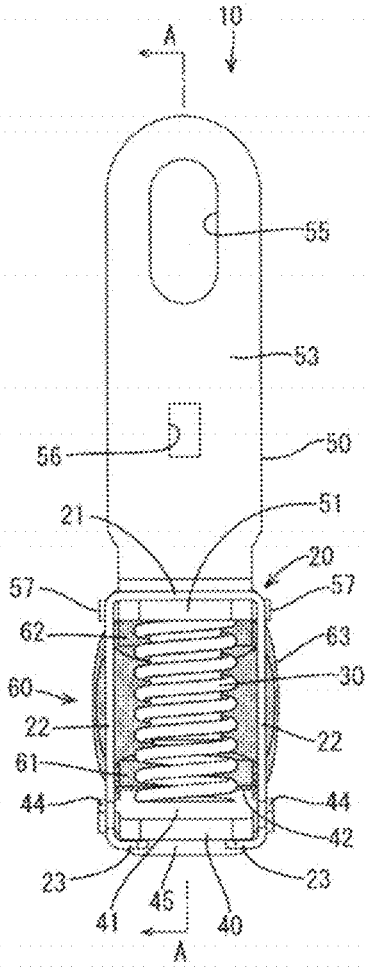
FIG. 2 is a side view of the terminal viewed from a side opposite to a wire.
Figure 3:
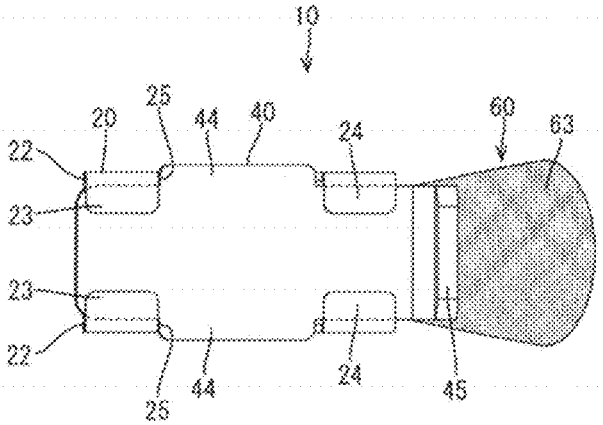
FIG. 3 is a bottom view of the terminal.

The case 20 is formed by press-working a metal plate material such as a SUS material and includes, as shown in FIG. 2, a ceiling wall 21, two side walls 22 extending down from both sides of the ceiling wall 21 and supports 23, 24 extending in from the lower edges of the side walls 22 to face the ceiling wall 21. As shown in FIG. 3, the supports 23, 24 are composed of two first supports 23 disposed on a shown left end of the first conductive member 40 and two second supports 24 disposed on a shown right end of the first conductive member 40.

Figure 4:
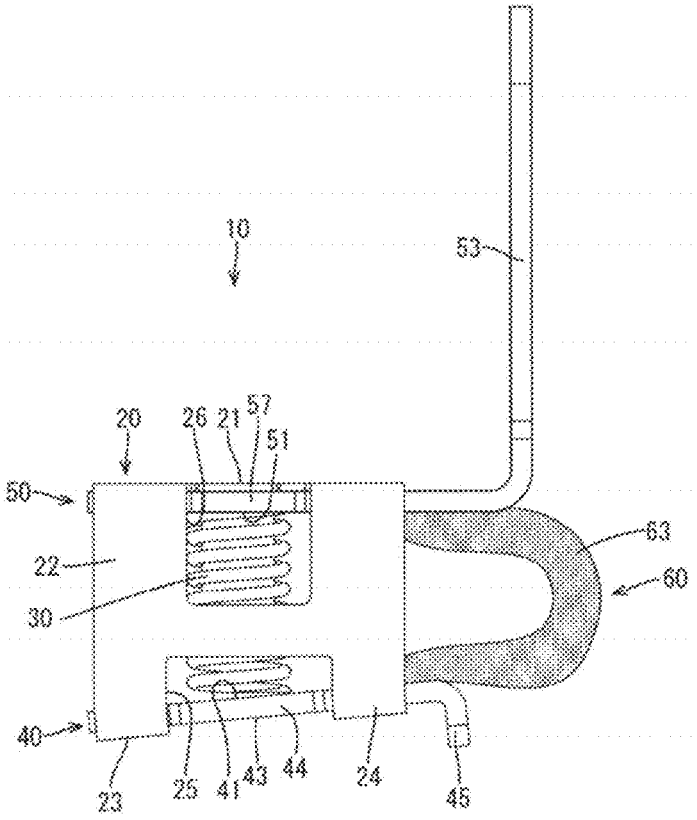
FIG. 4 is a front view of the terminal.
Figure 5:
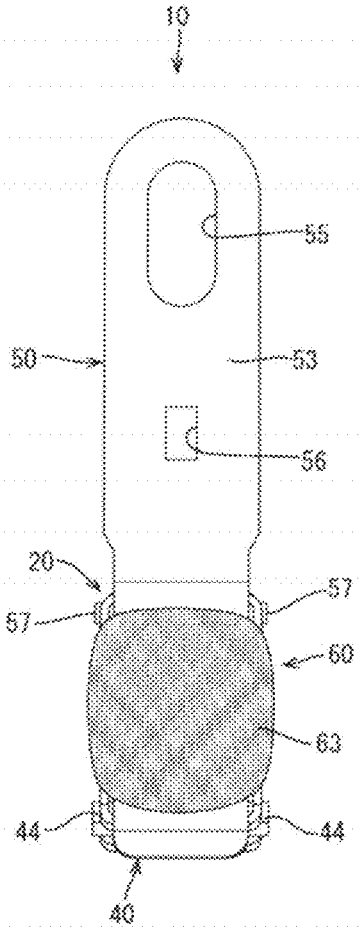
FIG. 5 is a side view of the terminal viewed from the wire side.
Figure 6:
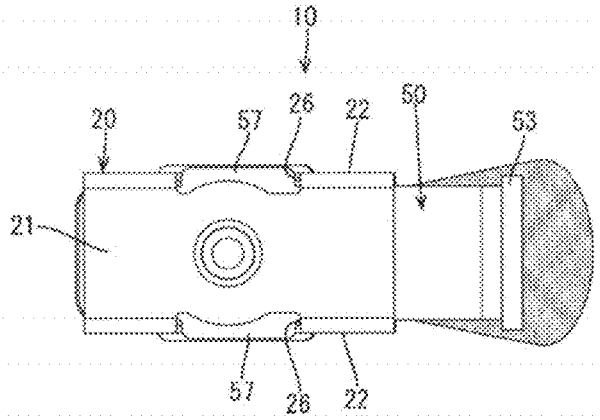
FIG. 6 is a plan view of the terminal.
Figure 7:
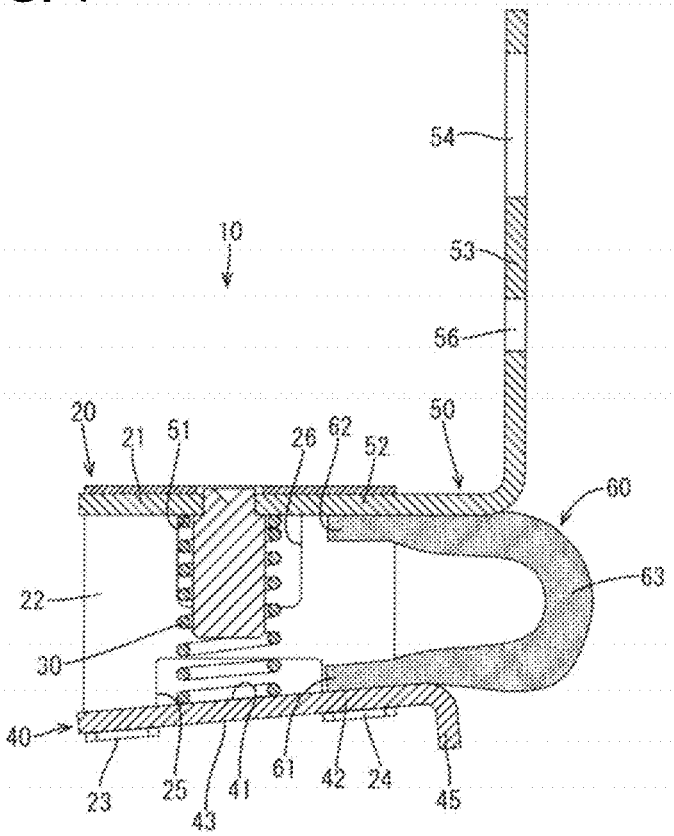
FIG. 7 is a section along A-A in FIG. 2.

As shown in FIG. 4, a first opening 25 is provided between the first and second supports 23 and 24 in each side wall 22. A second opening 26 narrower and vertically longer than the first opening 25 is provided above the first opening 25 in each side wall 22. Further, as shown in FIG. 7, an interval between the first support 23 and the ceiling wall 21 is larger than an interval between the second support 24 and the ceiling wall 21. The first and second supports 23 and 24 are coplanar.

The coil spring 30 is formed by coiling a metal wire material of SUS or the like and sandwiched in a compressed state by the first and second conductive members 40, 50. Thus, the coil spring 30 biases both the first and second conductive members 40, 50. By this biasing force, the first conductive member 40 is sandwiched between the first or lower end of the coil spring 30 and inner surfaces of the respective supports 23, 24 and the second conductive member 50 is sandwiched between the second or upper end of the coil spring 30 and the inner surface of the ceiling wall 21.

The first conductive member 40 is formed by press-working a metal plate material, such as copper alloy and includes, as shown in FIG. 7, a spring receiving portion 41 for supporting the lower end of the coil spring 30 and a wire connecting portion 42 supported by the second supports 24 of the case 20. The wire 60 in this embodiment is connected to the wire connecting portion 42 by welding or caulking. The spring receiving portion 41 is located between the first and second supports 23 and 24 and is exposed to the outside of the case 20 in the first openings 25 of the case 20. The lower surface of the spring receiving portion 41 serves as a contact portion 43 with a mating terminal 110 to be described later. The contact portion 43 is arranged on an axis of the coil spring 30 and between the first and second supports 23 and 24.

The first conductive member 40 is accommodated mostly inside the case 20, but two protruding pieces 44 provided on both side edges of the spring receiving portion 41 and a bent piece 45 extending down from an end edge on the side of the wire connecting portion 42 are disposed outside the case 20. The two protruding pieces 44 are accommodated respectively in the two first openings 25. The protruding pieces 44 contact opening edge parts of the first openings 25 in the front-rear direction (lateral direction in FIG. 4), thereby allowing an upward movement of the first conductive member 40 while suppressing movements of the first conductive member 40 in the front-rear direction.

On the other hand, the second conductive member 50 is formed by press-working a metal plate material such as copper alloy and includes a spring receiving portion 51 for supporting the upper end of the coil spring 30, a wire connecting portion 52 disposed at a position facing the wire connecting portion 42 of the first conductive member 40 and a device-side connecting portion 53 rising upward while being perpendicular to the wire connecting portion 52. Further, the device-side connecting portion 53 is provided with a bolt hole 55 and a locking hole 56.

Two protruding pieces 57 are provided on both side edges of the spring receiving portion 51. The protruding pieces 57 are accommodated respectively in the two second openings 26. The protruding pieces 57 come into contact with opening edge parts of the second openings 26 in the front-rear direction (lateral direction in FIG. 4), thereby allowing a downward movement of the second conductive member 50 while suppressing movements of the second conductive member 50 in the front-rear direction.

As shown in FIG. 7, the wire 60 is composed of a first end portion 61 connected to the wire connecting portion 42 of the first conductive member 40, a second end portion 62 connected to the wire connecting portion 52 of the second conductive member 50 and an intermediate part 63 coupling the first and second end portions 61, 62. The intermediate part 63 is disposed outside the case 20 and substantially U-shaped. Since the wire 60 is flexible, the intermediate part 63 is deflected and deformed if the first and second conductive members 40, 50 relatively move. Since the intermediate part 63 constantly is disposed outside the case 20, a wire diameter is not limited by the size of the coil spring 30 and the size of the case 20. Thus, a thick wire 60 for large current can be used. Further, since only the coil spring 30 is accommodated inside the case 20, it is also possible to use a coil spring larger than the currently used coil spring 30.

Figure 8:
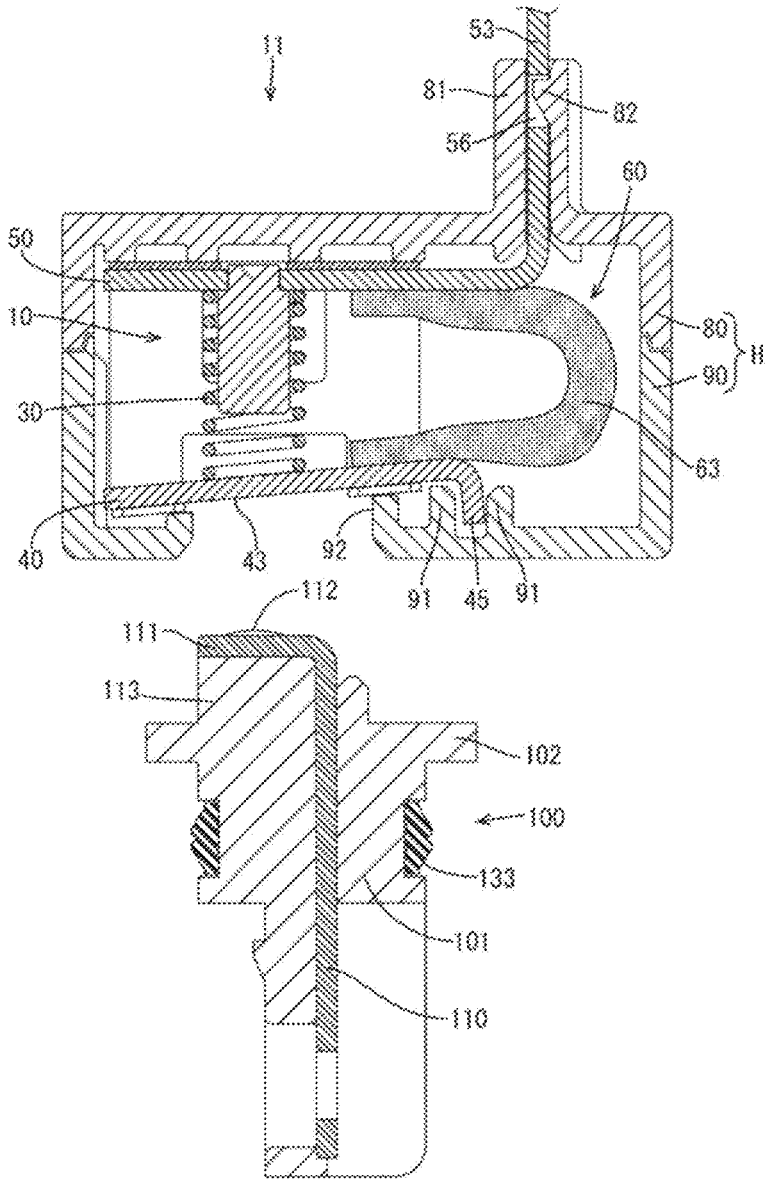
FIG. 8 is a section showing a state before a mating connector is connected to a connector.

As shown in FIG. 8, the terminal 10 is accommodated inside a housing H composed of upper and lower insulating members 80, 90. A connector 11 is constituted by the terminal 10 and the housing H. Two position restricting ribs 91 are provided on a bottom wall of the lower insulating member 90, and the bent piece 45 of the first conductive member 40 is accommodated between the two position restricting ribs 91. In this way, movements of the terminal 10 in the front-rear direction (lateral direction in FIG. 8) inside the housing H are suppressed.

On the other hand, the upper insulating member 80 is provided with a lead-out portion 81 for leading out the device-side connecting portion 53 to the outside of the housing H. A locking lance 82 is provided inside the lead-out portion 81. This locking lance 82 is fit into the locking hole 56 of the device-side connecting portion 53 to be locked, thereby suppressing a movement of the second conductive member 50 inwardly of the housing H. The intermediate part 63 of the wire 60 is disposed below the lead-out portion 81 and is an area from the first end portion 61 to the second end portion 62 of the wire 60. The intermediate part 63 is disposed outside the case 20, but inside the housing H in a manner to avoid interference with the inner wall of the housing H.

The lower insulating member 90 is provided with a fitting recess 92 having an opening for exposing the contact portion 43 of the first conductive member 40 to the outside. On the other hand, a mating connector 100 to be connected to the connector 11 includes a mating housing 101 made of synthetic resin and the mating terminal 110 insert-molded in the mating housing 101. The mating terminal 110 is L-shaped, and the mating contact portion 111 facing the contact portion 43 is provided on one end of the mating terminal 110. A spherical portion 112 circular in a plan view is formed on the upper surface of the mating contact portion 111 by striking the mating contact portion 111 from the lower surface. The mating contact portion 111 is disposed in a fitting portion 113 and can fit into the fitting recess 92 of the connector 11.

Figure 9:
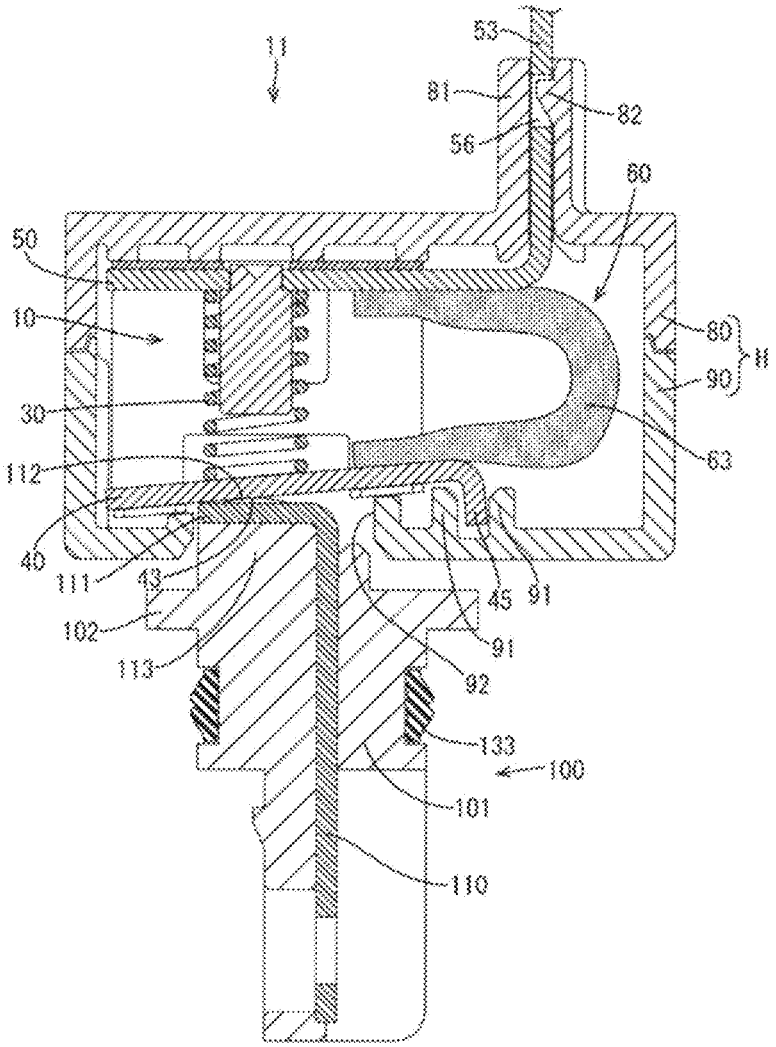
FIG. 9 is a section showing a state where a mating contact portion is butted against a first conductive member from the state of FIG. 8.
Figure 10:
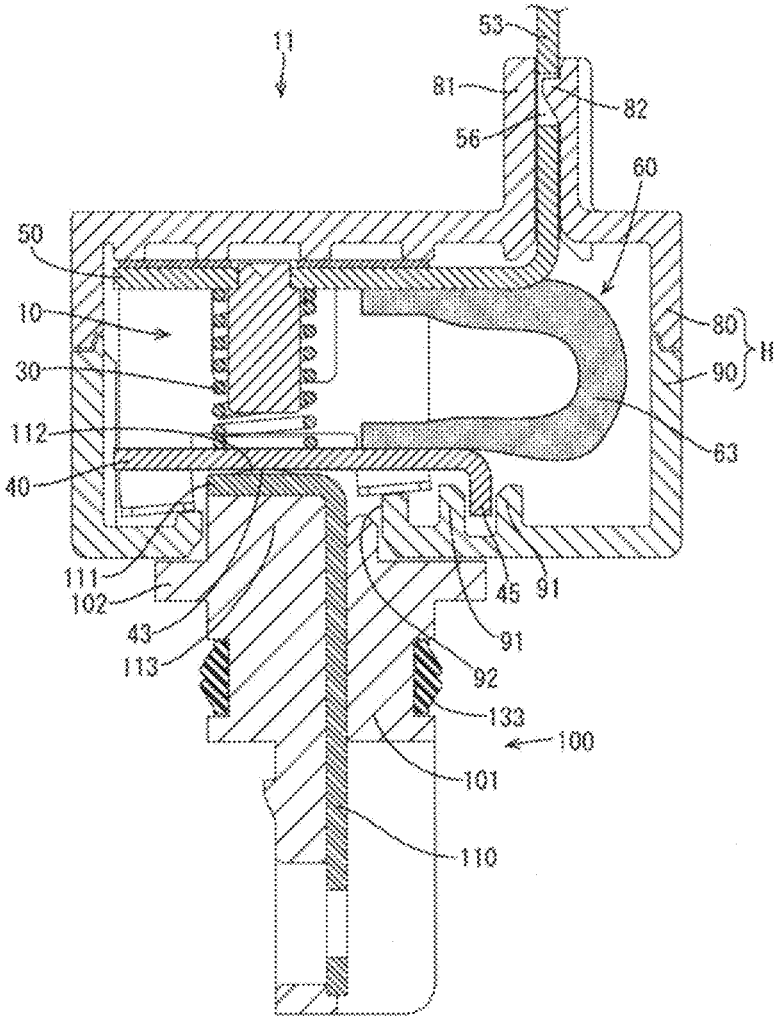
FIG. 10 is a section showing a state where the first conductive member is pushed into a case by butting the mating contact against the first conductive member from the state of FIG. 9.

As the fitting portion 113 is fit into the fitting recess 92, the spherical portion 112 contacts the contact portion 43, as shown in FIG. 9. As the fitting portion 113 is fit farther, the first conductive member 40 is lifted up and the coil spring 30 is compressed as shown in FIG. 10. Further, the wire 60 is deflected slightly by a movement of the first conductive member 40, but does not contact the inner wall of the housing H. The coil spring 30 is set in the compressed state in advance. Thus, a large spring force is generated only by slightly deflecting the coil spring 30. In this way, a spring force of the coil spring 30 is generated and produces a predetermined contact pressure between the spherical portion 112 of the mating terminal 110 and the contact portion 43 of the terminal 10. Thus, the mating terminal 110, the first conductive member 40, the wire 60 and the second conductive member 50 are connected conductively.

Figure 11:
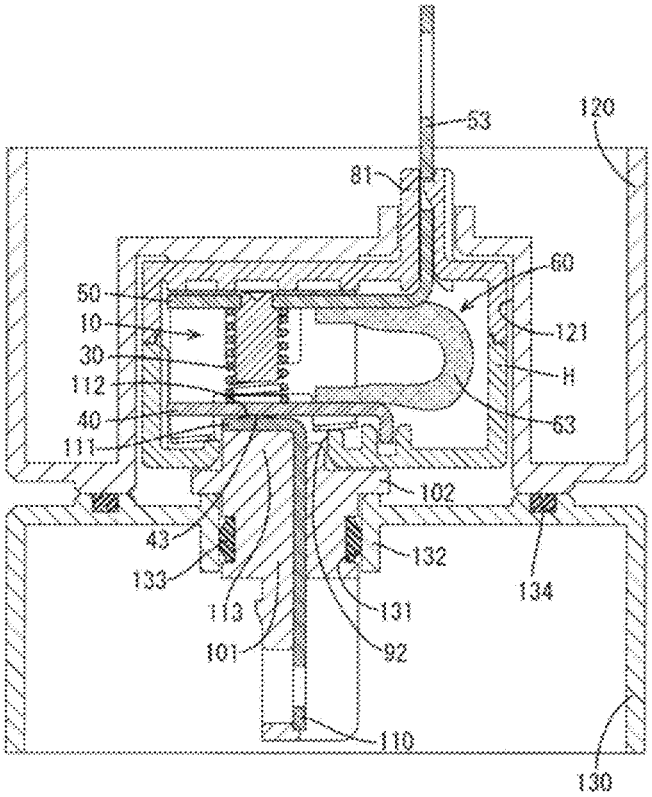
FIG. 11 is a section showing a use example of the terminal of the embodiment.

Next, a use example of the connector 11 of this embodiment is described with reference to FIG. 11. The connector 11 is mounted in a mounting recess 121 provided by recessing the lower surface of an inverter case 120, and only the lead-out portion 81 and the device-side connecting portion 53 of the second conductive member 50 are introduced into the inverter case 120. On the other hand, the mating connector 100 is disposed inside a mounting hole 131 that penetrates through a motor case 130. A peripheral wall 132 is provided around the mounting hole 131 and a flange 102 of the mating housing 101 is supported on the peripheral wall 132.

Further, a rubber ring 133 is sandwiched between the mating housing 101 and the peripheral wall 132. Furthermore, a packing 134 arranged to circle the mating connector 100 is sandwiched between the upper surface of the motor case 130 and the inverter case 120. In this way, a water-stop region is ensured inside the both cases 120, 130 and the both connectors 11, 100 are connected conductively in this water-stop region. Accordingly, the mating terminal 110 and the first conductive member 40 need not be bolted, and the electrical connection of the connectors 11, 100 is completed merely by mounting the inverter case 120 on the motor case 130. Thus, a connecting operation is simplified and work efficiency is improved.

As described above, the wire 60 having the wire diameter larger than the inner diameter of the coil spring 30 can be used. Thus, a thicker wire 60 can be used as compared to the case where the wire 60 is arranged inside the coil spring 30. Further, the coil spring 30 is accommodated in the compressed state inside the case 20. Therefore, a large contact pressure can be obtained even if a movement amount of the contact portion 43 is small.

The second conductive member 50 sandwiched between the second end of the coil spring 30 and the inner wall of the case 20 may be provided. The first end of the wire 60 may be connected to the first conductive member 40, and the second end of the wire 60 may be connected to the second conductive member 50. Additionally, an area of the wire 60 from the first end to the second end may be disposed outside the case 20. According to this configuration, since the area of the wire 60 from the first end to the second end is disposed outside the case 20, the wire 60 having a wire diameter larger than the inner space of the case 20 can be used and a thicker wire 60 can be used as compared to the case where a wire is arranged inside the case 20.

The case 20 includes the first supports 23 for supporting first end of the first conductive member 40 and the second supports 24 for supporting the second end of the first conductive members 40. Additionally, the contact portion 43 is arranged on the axis of the coil spring 30 and between the first and second supports 23 and 24. According to this configuration, the contact portion 43 is arranged on the axis of the coil spring 30. Thus, a spring force of the coil spring 30 can be transferred directly to the contact portion 43. Further, since a force transferred from the coil spring 30 to the contact portion 43 is supported in a dispersed manner at two positions, i.e. at the first and second supports 23 and 24, a coil spring having an even larger spring force can be used.

The invention is not limited to the above described and illustrated embodiment. For example, the following various modes also are included.

Although the wire 60 disposed outside the coil spring 30 and outside the case 20 is illustrated in the above embodiment, a wire may be disposed outside the coil spring 30 and inside the case 20.

Although the braided wire is illustrated as a flexible wire in the above embodiment, a coated wire in which a core is covered with an insulation coating may be used.

Although the contact portion 43 arranged on the axis of the coil spring 30 is illustrated in the above embodiment, a contact portion may be arranged at a position deviated from the axis of the coil spring 30.

Although the case 20 made of the metal plate material is illustrated in the above embodiment, a case made of resin may be used.

Although the spherical portion 112 having a circular shape in a plan view is illustrated in the above embodiment, a spheroidal portion having an oval or elliptical shape in a plan view may be provided.

LIST OF REFERENCE SIGNS

10 . . . terminal
20 . . . case
23 . . . first support
24 . . . second support
30 . . . coil spring
40 . . . first conductive member
43 . . . contact portion
50 . . . second conductive member
60 . . . wire
61 . . . first end portion (one end)
62 . . . second end portion (other end)
63 . . . intermediate part (area from one end to other end)

The invention claimed is:

1. A terminal, comprising:

a case including a first opening;

a coil spring having opposite first and second ends and being accommodated in a compressed state inside the case;

a first conductive member sandwiched between the first end of the coil spring and a first inner wall of the case and including a contact portion movable in a direction to compress the coil spring farther, the contact portion being a plate disposed inside the case, and being exposed to outside of the case in the first opening;

a second conductive member sandwiched between the second end of the coil spring and a second inner wall of the case;

a flexible wire disposed outside the coil spring, the flexible wire having a first end connected to the first conductive member and a second end connected to the second conductive member, and an area of the wire from the first end to the second end is disposed outside the case.

2. The terminal of claim 1, wherein:

the case includes a first support for supporting the first end of the first conductive member and a second support for supporting the second end of the first conductive member; and the contact portion is arranged on an axis of the coil spring and between the first and second supports.

3. A terminal comprising:

a case including an opening, a first support;

a coil spring having opposite first and second ends and being accommodated in a compressed state inside the case;

a conductive member sandwiched between the first end of the coil spring and an inner wall of the case, the conductive member including a first end supported on the first support of the case, a second end supported on the second support of the case and a contact portion disposed inside the case and being exposed to outside of the case at the opening, the contact portion being arranged on an axis of the coil spring and between the first and second supports, and the contact portion being movable in a direction to compress the coil spring farther; and a flexible wire connected to the first conductive member being disposed outside the coil spring.

4. The terminal of claim 3, wherein the conductive member is a first conductive member and the inner wall of the case is a first inner wall, the terminal further having a second conductive member sandwiched between the second and of the coil spring and a second inner wall of the case, the flexible wire further being connected to the second conductive member.

5. The terminal of claim 4, wherein the second conductive member has an end extending to a location outside the case.

6. The terminal of claim 3, wherein the case is formed from a conductive metal.

* * * * *